US006352647B1

(12) United States Patent
Rolfson

(10) Patent No.: US 6,352,647 B1
(45) Date of Patent: Mar. 5, 2002

(54) MASK, AND METHOD AND APPARATUS FOR MAKING IT

(75) Inventor: J. Brett Rolfson, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/304,965

(22) Filed: May 5, 1999

(51) Int. Cl.[7] ..... B44C 1/22

(52) U.S. Cl. ..... 216/12; 216/87; 216/96; 216/100; 438/510; 438/514; 156/345

(58) Field of Search ..... 156/345; 216/12, 216/87, 96, 100; 438/510, 514

(56) References Cited

U.S. PATENT DOCUMENTS

| | | | | |
|---|---|---|---|---|
| 4,966,663 A | * 10/1990 | Mauger | 204/129.3 |
| 5,302,238 A | 4/1994 | Roe et al. | 156/643 |
| 5,674,785 A | 10/1997 | Akram et al. | 437/217 |
| 5,694,685 A | * 12/1997 | Millas | 29/890.031 |
| 5,766,829 A | 6/1998 | Cathey, Jr. et al. | 430/394 |
| 5,861,328 A | 1/1999 | Tehrani et al. | 438/210 |
| 5,872,044 A | 2/1999 | Hemmenway et al. | 438/426 |

FOREIGN PATENT DOCUMENTS

| | | | | |
|---|---|---|---|---|
| DE | DL142934 | * | 7/1980 | C23F/01/04 |

* cited by examiner

*Primary Examiner*—Randy Gulakowski
*Assistant Examiner*—M. Kornakov
(74) *Attorney, Agent, or Firm*—Dickstein Shapiro Morin & Oshinsky LLP

(57) ABSTRACT

Methods of making hardmask assemblies or other layered structures, and other masks, include providing an annular seal member between a first surface of layered structure, preferably a hardmask assembly, and a first clamp element, the hardmask assembly comprising at least a hardmask layer; and applying a force between the first clamp element and a second clamp element to hold the hardmask assembly between the annular seal member and the second clamp element. In addition, there are provided methods further comprising etching the first surface of the hardmask assembly within the bounds of an interior space defined by the annular seal member. Methods further comprise etching the substrate layer through the hardmask layer and/or removing the hardmask layer after etching the substrate layer.

25 Claims, 3 Drawing Sheets

MASK, AND METHOD AND APPARATUS FOR MAKING IT

FIELD OF THE INVENTION

The present invention relates to semiconductor device manufacturing. More particularly, the present invention is directed to a simplified method for patterning the membrane area for a membrane-type mask, such as a stencil mask.

BACKGROUND OF THE INVENTION

It is well known that membrane-type masks (e.g., stencil masks) can be used for many different types of purposes. One example of an area of great importance in which membrane-type masks are used is in lithographic systems (e.g., photolithography), which utilize stencil masks to pattern resist coated targets, such as are used in integrated circuit fabrication. These stencil masks typically include a substrate or support structure and a hardmask layer, which is typically a thin membrane which carries a mask pattern.

Integrated circuits are typically fabricated on a wafer of semiconductor material such as silicon or gallium arsenide. During the fabrication process, the wafer is subjected to an ordered series of steps, which may include photomasking, material deposition, oxidation, nitridization, ion implantation, diffusion, etching, and others, in order to achieve a final product.

A variety of techniques are known for making membrane masks. For example, U.S. Pat. No. 5,766,829 discloses a method in which a baseplate 40 (which can be formed of a material such as single crystal silicon, or amorphous silicon deposited on a glass substrate) contains circuitry and electrical devices which control the operation of a field emission display. For etching field emitter sites 38 (FIG. 3C) for the baseplate 40, a mask layer 42 is deposited on the baseplate 40. A layer of positive tone photoresist 44 is deposited on the mask layer 42, The photoresist 44 is then exposed and developed. Next, the photoresist 44 is used to etch the mask layer 42 to form a hard mask 46. Following formation of the hard mask 46, the photoresist 44 is stripped. Next, the baseplate 40 is etched using the hard mask 46 to form pointed emitter sites 38. Following formation of the emitter sites 38 the hard mask 46 is stripped using an etchant that is selective to the baseplate 40.

The manufacture of such prior art masks requires a high degree of precision, and such steps are typically carried out many times. There accordingly has been a need for a method for manufacturing such masks which reduces and/or simplifies the number of required processing steps.

SUMMARY OF THE INVENTION

The present invention provides a method of making an etched assembly, comprising providing an annular seal member between a first surface of a first assembly and a first clamp element, the first assembly comprising at least a first layer, a second layer and a third layer;

applying a force between the first clamp element and a second clamp element to hold the first assembly between the annular seal member and the first clamp element; and etching the first surface of the first assembly within the bounds of an interior space defined by the annular seal member.

In a preferred aspect, the present invention provides a method of making a hardmask etched assembly, comprising:

providing an annular seal member between a first surface of a hardmask assembly and a first clamp element, the hardmask assembly comprising at least a hardmask layer; and applying a force between the first clamp element and a second clamp element to hold the hardmask assembly between the annular seal member and the second clamp element.

The hardmask assembly preferably further comprises a substrate layer and a membrane layer. In a preferred aspect of the invention, the hardmask assembly is preferably provided by doping a first section of a substrate to form a membrane layer in a first section of said substrate, and applying a hardmask material to the substrate layer to form a hardmask layer on the substrate layer.

The method preferably further comprises any of the following:

etching the first surface of the hardmask assembly within the bounds of an interior space defined by the annular seal member;

etching a mask pattern in the membrane layer;

etching the substrate layer through the hardmask layer; and removing the hardmask layer after etching the membrane layer.

In addition, the present invention provides articles made in such processes, for example, articles comprising a membrane layer having a pattern formed therein, a substrate layer and a hardmask layer, the hardmask layer having a hardmask pattern formed therein.

The present invention is further directed to integrated circuits which incorporate one or more components made using any of the articles according to the present invention, e.g., the membrane masks of the present invention can be used in processing such components. In addition, the present invention is directed to structures used in making articles according to the present invention, as described herein.

The invention may be more fully understood with reference to the accompanying drawings and the following description of the embodiments shown in those drawings. The invention is not limited to the exemplary embodiments and should be recognized as contemplating all modifications within the skill of an ordinary artisan.

DETAILED DESCRIPTION OF PREFERRED EMBODIMENTS OF THE INVENTION

A preferred embodiment of a method in accordance with the present invention is shown schematically in FIGS. 1A–1F.

Figure 1A:
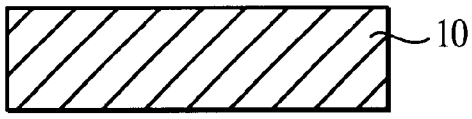
FIGS. 1A–1F are schematic cross-sectional drawings showing an article in various stages of production according to a preferred method in accordance with the present invention, as well as a preferred embodiment of an apparatus for use in such a method.
Figure 1B:
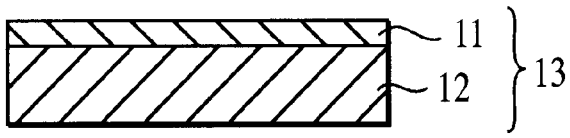

In accordance with this embodiment, a substrate 10 is provided (see FIG. 1A). The substrate 10 is doped with a suitable dopant such that a layer within the substrate is converted to a membrane layer, thereby providing a substrate/membrane assembly 13 comprising a membrane layer 11 and a substrate layer 12 (see FIG. 1B).

Next, the membrane layer 11 is patterned using any suitable patterning method, e.g., photolithography followed by etching. The expression "membrane layer" is used herein to refer to either a membrane layer which has not yet been patterned and/or to a membrane layer which has been patterned.

Figure 1C:
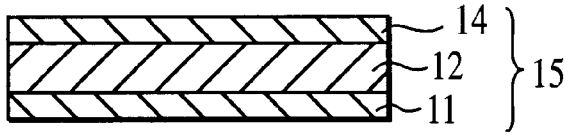

Next, a hardmask layer 14 is deposited on the substrate layer 12, thereby forming a hardmask assembly 15 (see FIG. 1C).

Figure 1D:
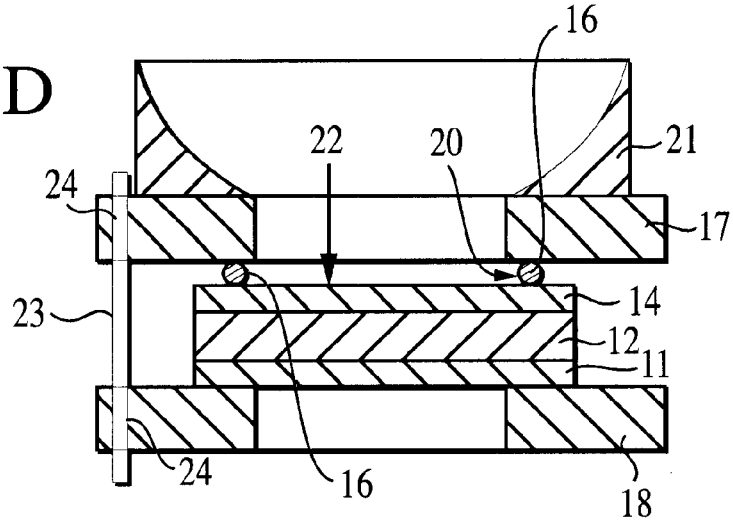

Next, the hardmask assembly 15 is positioned such that the hardmask layer 14 is in contact with an annular seal member 16 which in turn is in contact with a first clamp element 17 (see FIG. 1D). Then, force is applied between the first clamp element 17 and a second clamp element 18 to hold the hardmask assembly between the annular seal member 16 and the second clamp element 18.

Next, an etchant is supplied to a first surface 22 of the hardmask assembly 15 within the bounds of a space 19 defined by the inner surface 20 of the annular seal member 16 (see FIG. 1E), and the hardmask layer 14 is etched to form a hardmask pattern in the hardmask layer 14, the hardmask pattern corresponding to the parts of the first surface 22 of the hardmask assembly 15 within the outline of the inner surface 20 of the annular seal member.

Next, the substrate layer 12 is etched through the hardmask pattern formed in the hardmask layer 14.

Finally, if desired, the hardmask layer 14 is removed by etching.

Through the inclusion of a hardmask layer 14 in accordance with the present invention, simplified processing is obtained in comparison to prior art methods, and wafer breakage is reduced. In particular, the presence of the hardmask layer 14 avoids problems which would otherwise be faced when removing the hardmask assembly from the annular seal member after the hardmask layer 14 has been patterned and optionally after the substrate layer 12 has been etched through the hardmask layer 14, and optionally after the hardmask layer 14 has been removed. Such problems would include the annular seal member sticking to the substrate layer 12 (i.e., if no hardmask layer were present), and damage or even breakage of the wafer caused by force used to overcome such sticking.

The term "layer" is used herein either to refer to individual elements which may be brought into contact with one another, e.g., to form a laminate, or to refer to a region of an article which is distinguishable from neighboring regions with regard to at least one property, e.g., its composition. For example, as described in more detail below, a hardmask assembly can be provided by starting with an article of silicon, and then implanting dopant and driving the dopant to a specific depth into the silicon article. The areas into which the dopant is driven is a membrane layer, while the remainder of the article, which does not include substantial dopant, is a substrate layer.

The term "annular" is used herein to refer to any structure which can be contacted with planar surfaces on opposite sides of the structure such that parts of the surfaces and inner surfaces of the structure define the bounds of an interior space. Thus, "annular" is not limited to only toroidal shapes.

The term "mask" should be interpreted as including hardmask assemblies, hardmask etched assemblies, and all other articles obtained in accordance with the methods described herein from further treatments of hardmask assemblies as described herein.

The substrate 10 can be any suitable material, and a preferred example is silicon.

In one example of an embodiment of a process for making a substrate/membrane assembly, a silicon substrate is provided. The silicon substrate can be a standard wafer used in semiconductor fabrication processes. In an illustrative embodiment, the substrate can be cleaned using a suitable process such as an RCA clean.

Next, an N+ implant can be performed. The N+ implant can be performed using ion implantation of an n-type dopant such as P- or As- into a surface of the substrate. A dopant activation-drive step can then be performed to activate and drive the dopant into the substrate to a selected depth "d". This step can be performed by heating the substrate to a temperature between about 900 degrees C. and 1200 degrees C. The dopant is preferably driven into the substrate a depth of about 2 to 5 microns, whereby there is provided a membrane layer 11 of such thickness.

The patterning of the membrane layer 11 is performed by any suitable technique, e.g., photolithographic patterning and etching, as is well known to those skilled in the art. The patterning of the membrane layer 11 can be performed before or after etching the hardmask, before or after etching the substrate layer, and before or after removing the hardmask (if the hardmask is removed).

The hardmask layer can be deposited in accordance with any suitable technique, a variety of which, e.g., coating, would be readily apparent to those skilled in the art. Suitable materials for use in making the hardmask include silicon nitride, silicon oxynitride and/or silicon dioxide. In a preferred embodiment, the hardmask comprises a layer of silicon dioxide in contact with the silicon substrate, the silicon dioxide layer having a thickness of about 100 angstroms, and a thicker layer of silicon nitride on the layer of silicon dioxide, the layer of silicon nitride having a thickness of about 4000 angstroms.

A preferred fixture for holding the hardmask assembly during the step of patterning the hardmask layer includes a bowl-shaped section 21 (see FIG. 1D) formed as part of the first clamp element. As will be readily understood by those of skill in the art, a variety of different structural elements could be made which serve the function of retaining the etchant in the etchant space 19, and such structural elements could be made as separate elements or be integral with other elements in the fixture, e.g., the first clamp element 17.

The first damp element 17 and the second clamp element 18 can take any form which can be used to apply force to move them and/or urge them toward each other. Those of skill in the art can readily envision or develop a variety of structures which function in this way, and all such varieties are included in the present invention and covered by the expressions "first clamp element" and "second clamp element." In addition, those of skill in the art can readily envision or develop additional elements which can be used to provide forces necessary to cause the clamp elements to function in the desired way, and all such modifications are included in the present invention. Naturally, either one or both of the first and second clamp elements can be movable. In a preferred embodiment, as shown in FIG. 1D, one or more screws 23 are provided in corresponding through-holes 24, so as to provide a simple way of providing force between the first and second clamp elements.

The first and second clamp elements can be formed of any suitable material, a preferred example being Plexiglas (or high molecular weight PMMA), but those of skill in the art will recognize that a variety of materials could be used. Plexiglas is useful because it is easy to machine screw-holes (if provided) and/or grooves (discussed below) for mounting annular seal members.

One or more groove 25 is preferably formed in the first clamp element so as to provide structure which tends to keep the annular seal member 16 within the groove 25. The groove(s) 25 preferably is of a shape which corresponds to the annular seal member 16 so that the annular seal member 16 fits partially within the groove 25. Any number of annular seal members can be positioned between the first clamp element 17 and the hardmask 14, and one or more similar annular seal member can also be positioned between the second clamp element 18 and the membrane layer 11. The expression "grooves" should be understood as including the provision of other types of surface features, such as a raised rim instead of a slot, in the first clamp element 17 and/or the second clamp element 18.

The annular seal member 16 can be formed of any of a variety of materials, as those of skill in the art can readily appreciate. For example, suitable materials for forming the annular seal member 16 include polyethylene. The annular seal member 16 is formed of a material which is highly resistant to the etchant which is used, so that it will not be degraded when it is contacted by the etchant The annular seal member 16 may be in any shape which can be used to define the etchant space 19 (see FIG. 1E) into which the etchant is introduced. One example of a preferred shape is an o-ring.

Figure 1E:
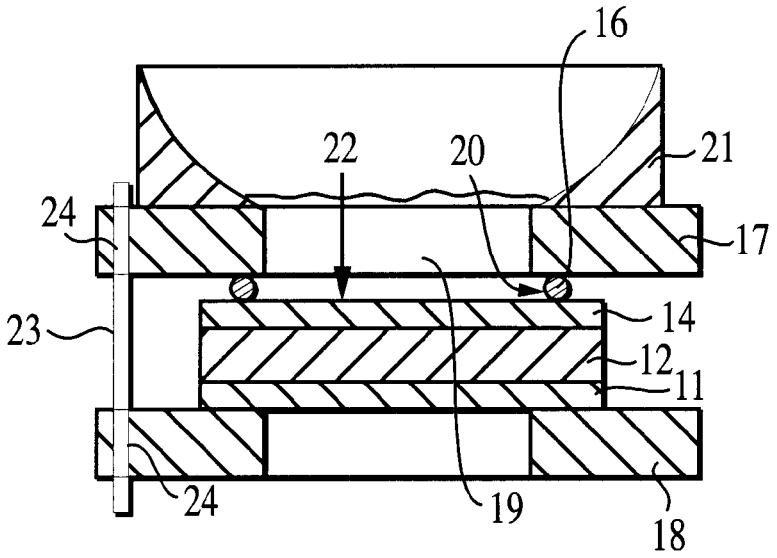
Figure 1F:
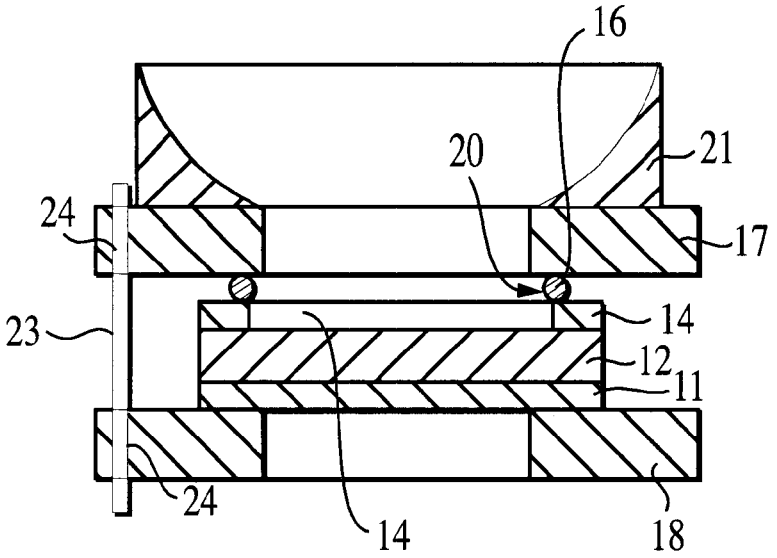
Figure 2:
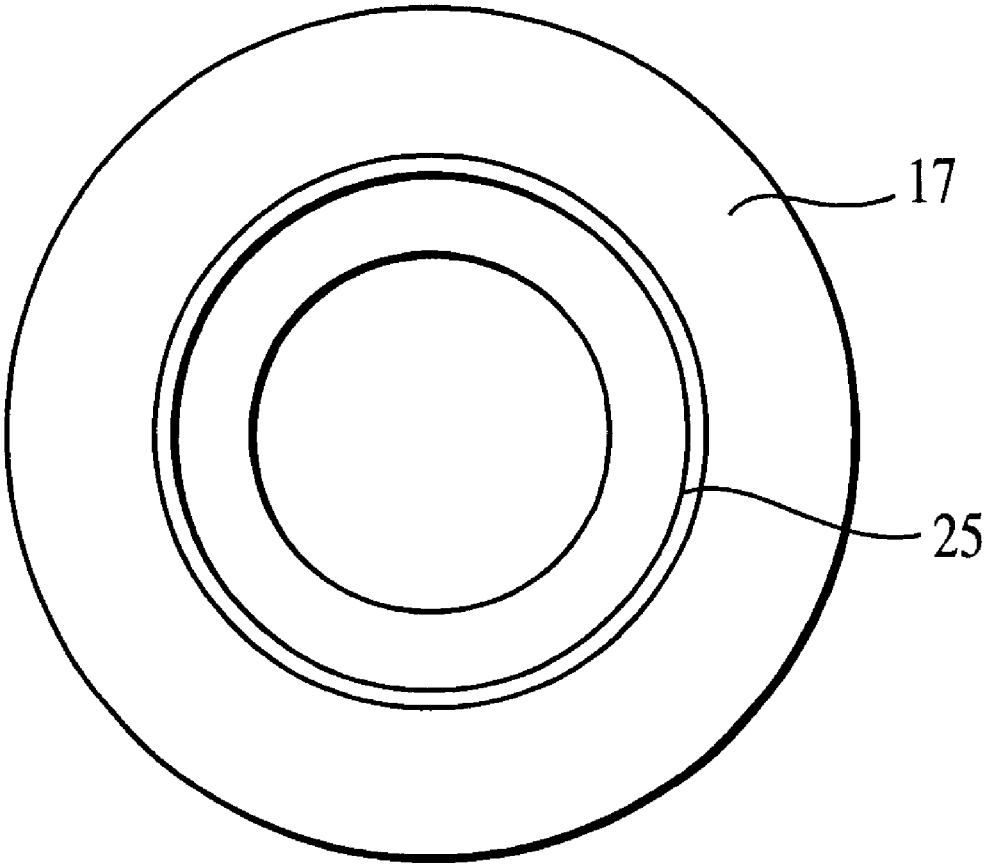
FIG. 2 is a top view of a first clamp element in the apparatus shown in FIGS. 1D–1F.

The step of etching the hardmask is shown in FIG. 1E, where etchant has been supplied to the etchant space 19. The etchant for etching the hardmask can be any fluid which is capable of etching the hardmask layer 14, and which preferably does not substantially etch the substrate layer 12, thereby producing a hardmask etched assembly. An example of a preferred etch fluid is solution of hydrofluoric acid (HF), e.g., a solution of 49% HF and 51% deionized water. The etchant is preferably poured into the bowl-shaped section 21, from which it feeds into the etchant space 19.

The step of etching the substrate layer 12 through the hardmask layer 14 is conducted using an etchant which is effective for etching the substrate layer 12, a suitable example being potassium hydroxide solution. Preferably, an electrical connection is provided, as is known in the art, to control the etching of the substrate layer 12. The etching of the substrate layer 12 preferably does not go through the interface between the substrate layer 12 and the membrane layer 11 and into the membrane layer 11, but rather, stops at this interface. Techniques for stopping the etching at a given depth are well known and are included in the present invention.

The step of etching the substrate layer 12 through the hardmask layer 14 is preferably conducted in a second fixture, slightly different from the fixture in which the hardmask layer 14 is patterned, in that the second fixture has an annular seal member which defines a larger inner area than the annular seal member 16 in the first fixture. In such a way, the annular seal member in the second fixture can be placed in contact with the remaining portions of the hardmask layer, and the removed portions of the hardmask layer correspond to the inner area defined by the annular seal member 16, as described above.

Finally, if desired, the hardmask layer 14 can be removed. A preferred method for removing the hardmask layer 14 comprises submerging the hardmask assembly in an etchant, e.g., an HF solution as described above, to remove the hardmask layer 14, but not attack the substrate layer 12 or the membrane layer 11.

Although the articles and methods in accordance with the present invention have been described in connection with preferred embodiments, it will be appreciated by those skilled in the art that modifications not specifically described may be made without departing from the spirit and scope of the invention defined in the following claims.

What is claimed is:

1. A method of making a hardmask assembly, comprising:

providing an annular seal member between a surface of a hardmask assembly and a first clamp element, said hardmask assembly comprising at least a hardmask layer; and applying a force between said first clamp element and a second clamp element to hold said hardmask assembly between said annular seal member and said second clamp element.

2. A method as in claim 1, further comprising etching said surface of said hardmask assembly within the bounds of an interior space defined by said annular seal member.

3. A method as in claim 1, wherein said hardmask assembly comprises at least one substrate layer, at least one membrane layer and said hardmask layer.

4. A method as in claim 1, wherein said first clamp element has a groove formed in a first clamp surface on said first clamp element, said annular seal member fitting in said groove.

5. A method as in claim 2, further comprising etching a substrate layer through said hardmask layer.

6. A method as in claim 5, ether comprising removing said hardmask layer after said etching said substrate layer.

7. A method of making a hardmask assembly, comprising:

doping a section of a substrate to form a membrane layer in said first section of said substrate, thereby providing a substrate/membrane assembly comprising at least said membrane layer and a substrate layer;

applying a hardmask material to said substrate layer to form a hardmask layer on said substrate layer, thereby forming a hardmask assembly comprising said membrane layer, said substrate layer and said hardmask layer;

contacting a surface of said hardmask layer with an annular seal member which is in contact with a first clamp element; and applying a force between said first clamp element and a second clamp element to hold said hardmask assembly between said annular seal member and said second clamp element.

8. A method as in claim 7, further comprising etching said surface of said hardmask assembly within the bounds of an interior space defined by said annular seal member.

9. A method as in claim 8, further comprising etching said substrate layer through said hardmask layer.

10. A method as in claim 9, further comprising removing said hardmask layer after said etching said substrate layer.

11. A method as in claim 7, wherein said first clamp element has a first groove formed in a first clamp surface on said first clamp element, said annular seal member fitting in said first groove.

12. A method of making a hardmask assembly, comprising:

applying a hardmask material to a substrate layer of a substrate/membrane assembly comprising said substrate layer and at least one membrane layer, thereby forming a hardmask assembly comprising said membrane layer, said substrate layer and a hardmask layer;

contacting a surface of said hardmask layer with an annular seal member which is in contact with a first clamp element; and applying a force between said first clamp element and a second clamp element to hold said hardmask assembly between said annular seal member and said second clamp element.

13. A method as in claim 12, further comprising etching said surface of said hardmask assembly within the bounds of an interior space defined by said annular seal member.

14. A method as in claim 13, further comprising etching said substrate layer through said hardmask layer.

15. A method as in claim 14, further comprising removing said hardmask layer after said etching said substrate layer.

16. A method as in claim 12, wherein said first clamp element has a first groove formed in a first clamp surface on said first clamp element.

17. A method of making a hardmask assembly, comprising:

doping a section of a substrate to form a membrane layer in said section of said substrate, thereby providing a substrate/membrane assembly comprising at least said membrane layer and a substrate layer;

applying a hardmask material to said substrate layer to form a hardmask layer on said substrate layer, thereby forming a hardmask assembly comprising said membrane layer, said substrate layer and said hardmask layer;

etching a mask pattern in said membrane layer;

contacting a surface of said hardmask layer with an annular seal member which is in contact with a first clamp element; and applying a force between said first clamp element and a second clamp element to hold said hardmask assembly between said annular seal member and said second clamp element.

18. A method as in claim 17, further comprising etching said first surface of said hardmask assembly within the bounds of an interior space defined by said annular seal member.

19. A method as in claim 18, further comprising etching said substrate layer through said hardmask layer.

20. A method as in claim 19, further comprising removing said hardmask layer after said etching said substrate layer.

21. A method as in claim 17, wherein said first clamp element has a first groove formed in a first clamp surface on said first clamp element.

22. A method of making an etched assembly, comprising:

providing an annular seal member between a first surface of a first assembly and a first clamp element, said first assembly comprising at least a first layer, a second layer and a third layer;

applying a force between said first clamp element and a second clamp element to hold said first assembly between said annular seal member and said first clamp element; and etching said first surface of said first assembly within the bounds of an interior space defined by said annular seal member.

23. A method as in claim 22, wherein said first layer comprises a hardmask layer, said second layer comprises a substrate layer and said third layer comprises a membrane layer.

24. A method as in claim 23, wherein said first surface of said first assembly is on said hardmask layer.

25. A method as in claim 22, wherein said first clamp element has a first groove formed in a first clamp surface on said first clamp element.

* * * * *